US006755504B2

(12) United States Patent
Tee et al.

(10) Patent No.: US 6,755,504 B2
(45) Date of Patent: Jun. 29, 2004

(54) INDEPENDENT WIPING OF PRINTHEAD

(75) Inventors: Ah Chong Tee, Singapore (SG); Bee Bee Ang, Singapore (SG)

(73) Assignee: Hewlett-Packard Development Company. LP., Houston, TX (US)

( * ) Notice: Subject to any disclaimer, the term of this patent is extended or adjusted under 35 U.S.C. 154(b) by 0 days.

(21) Appl. No.: 10/201,435

(22) Filed: Jul. 22, 2002

(65) Prior Publication Data

US 2003/0202035 A1 Oct. 30, 2003

(30) Foreign Application Priority Data

Apr. 26, 2002 (SG) ..... 200202535

(51) Int. Cl.[7] ..... B41J 2/165
(52) U.S. Cl. ..... 347/33
(58) Field of Search ..... 347/23, 24, 33

(56) References Cited

U.S. PATENT DOCUMENTS 5,103,244 A * 4/1992 Gast et al. ..... 347/33
5,440,331 A * 8/1995 Grange ..... 347/32
5,786,830 A * 7/1998 Su et al. ..... 347/33
5,984,450 A * 11/1999 Becker et al. ..... 347/24
6,126,265 A 10/2000 Childers et al.
6,139,128 A * 10/2000 Magirl et al. ..... 347/22
6,220,692 B1 * 4/2001 Iwaya et al. ..... 347/33
6,283,574 B1 * 9/2001 Sugimoto et al. ..... 347/23
6,345,878 B1 * 2/2002 Kanaya ..... 347/23

FOREIGN PATENT DOCUMENTS

EP 913263 A1 * 5/1999 ..... B41J/2/165
JP 4-235058 A * 8/1992 ..... B41J/2/18

* cited by examiner

*Primary Examiner*—Juanita Stephen
*Assistant Examiner*—Blaise Mouttet

(57) ABSTRACT

In a method for independently wiping a first and a second printhead of an inkjet printing device, a first and a second wiping assembly separated from each other are provided in the printing device. When the first wiping assembly wipes the first printhead, the second wiping assembly is separated from the second printhead so that the second wiping assembly does not simultaneously wipe the second printhead. When the second wiping assembly wipes the second printhead, however, the first wiping assembly is separated from the first printhead so that the first wiping assembly does not simultaneously wipe the first printhead.

5 Claims, 3 Drawing Sheets

INDEPENDENT WIPING OF PRINTHEAD

BACKGROUND

This invention relates generally to inkjet printing mechanisms, and in particular to techniques for maintaining inkjet printheads at its optimal conditions.

Inkjet printing mechanisms use pens which shoot drops of liquid colorant, referred to generally herein as "ink," onto a media sheet. Each pen has a printhead formed with very small nozzles through which the ink drops are fired. To print an image, each printhead is propelled back and forth across the media sheet, shooting drops of ink in a desired pattern as it moves. The particular ink ejection mechanism within the printhead may take on a variety of different forms known to those skilled in the art, such as those using piezoelectric or thermal printhead technology.

To clean and protect the printhead, typically a conventional "wiper assembly" mechanism is mounted within the housing of the printing mechanism so the printheads can be moved to a wiping region over the assembly for maintenance, specifically for wiping off ink residue as well as any paper dust or other debris that has collected on the printheads. Normally, a printhead needs wiping after a certain amount of printing operations or a certain period of idleness.

For a printing mechanism having more than one printhead, conventionally, all the printheads move to the wiping region together. Several flexible wiper-blades in close proximity to each other are provided in the conventional wiper assembly to wipe all the printheads simultaneously.

However, different printheads may have different needs for maintenance due to different characteristics and usage during printing operations. The fact that one printhead needs wiping normally does not justify the wiping of the other printheads. If all the printheads are wiped at the same time whenever one of them needs wiping, the printheads may be exposed to excessive amount of wiping. Potentially, such excessive wiping of the printheads may deteriorate the health of the printheads.

Furthermore, it is also observed that the conventional wiper assembly may cause an unwanted increase in the width of the printing mechanism. Such an unwanted increase in width may be undesirable, especially for printing mechanisms having very limited space.

Take a printer with two printheads for example. As shown in FIG. 3A, the conventional wiper assembly is conventionally positioned at one side, for example the right side, of the printer out of the printing area 106 within which ink drops are projected from at least one of the printheads onto a media sheet for imprinting images. During wiping operations, both printheads have to travel out of the printing area to be above the wiper assembly for wiping. On the other hand, during printing operations, only the right pen 305 needs to travel out of the printing area to allow the left pen 303 to shoot ink drops onto the right edge of the media sheet. Thus, in the design as shown in FIG. 3A, the printheads travel a longer distance to the right during wiping operations than during the printing operations. Such a longer distance may unnecessarily increase the width of the printing mechanism.

Therefore, there is a need for an improved printhead wiping mechanism which optimizes the amount of wiping for different printheads. There is a further need for an improved wiping mechanism that does not cause the unwanted increase in width of the printing mechanism.

SUMMARY

According to an aspect of the present invention, in a method for independently wiping a first and a second printhead of an inkjet printing device, a first and a second wiping assembly separated from each other are provided in the printing device. When the first wiping assembly wipes the first printhead, the second wiping assembly is separated from the second printhead so that the second wiping assembly does not simultaneously wipe the second printhead. When the second wiping assembly wipes the second printhead, however, the first wiping assembly is separated from the first printhead so that the first wiping assembly does not simultaneously wipe the first printhead.

According to a second aspect of the present invention, a method for wiping a first and a second printhead of an inkjet printing mechanism is provided. The printheads are movable along a scanning axis in the printing mechanism. In addition, a first and a second wiping assembly are respectively provided at a first and a second wiping region. These regions are separated by a substantial distance from each other along the scanning axis. During wiping operations, both printheads are moved together to, for example, the first wiping region where the first wiping assembly is located, and the first wiping assembly subsequently wipes the first printhead, without the second printhead being simultaneously wiped by the second wiping assembly.

According to a further aspect of the invention, an inkjet printing mechanism includes a chassis, a first and a second printhead, and a carriage supported by the chassis for transporting both printheads along a scanning axis. The printing mechanism includes a first wiping assembly located at a first wiping region for wiping the first printhead when the carriage moves to the first wiping region. The printing mechanism further includes a second wiping assembly located at a second wiping region for wiping the second printhead when the carriage moves to the second wiping region. According to the invention, the first and second wiping regions are separated by a substantial distance from each other along the scanning axis. Therefore, the two printheads are wiped independently by the two wiping assemblies respectively.

The printing mechanism generally has a printing area extending along the scanning axis, within which area ink drops are projected from at least one of the printheads onto a media sheet for imprinting images on it. Preferably, the first and second wiping assemblies are located at the opposite ends out of the printing area. The printing mechanism also has a sweeping area extending along the scanning axis, within which area the printheads travel during printing operations. Ideally, the wiping assemblies are located within the sweeping area for minimizing a width of the printing mechanism.

Other aspects and advantages of the invention will become apparent from the following detailed description in conjunction with the accompanying drawings; the description illustrates by way of example the principles of the invention.

DETAILED DESCRIPTION

Figure 1:
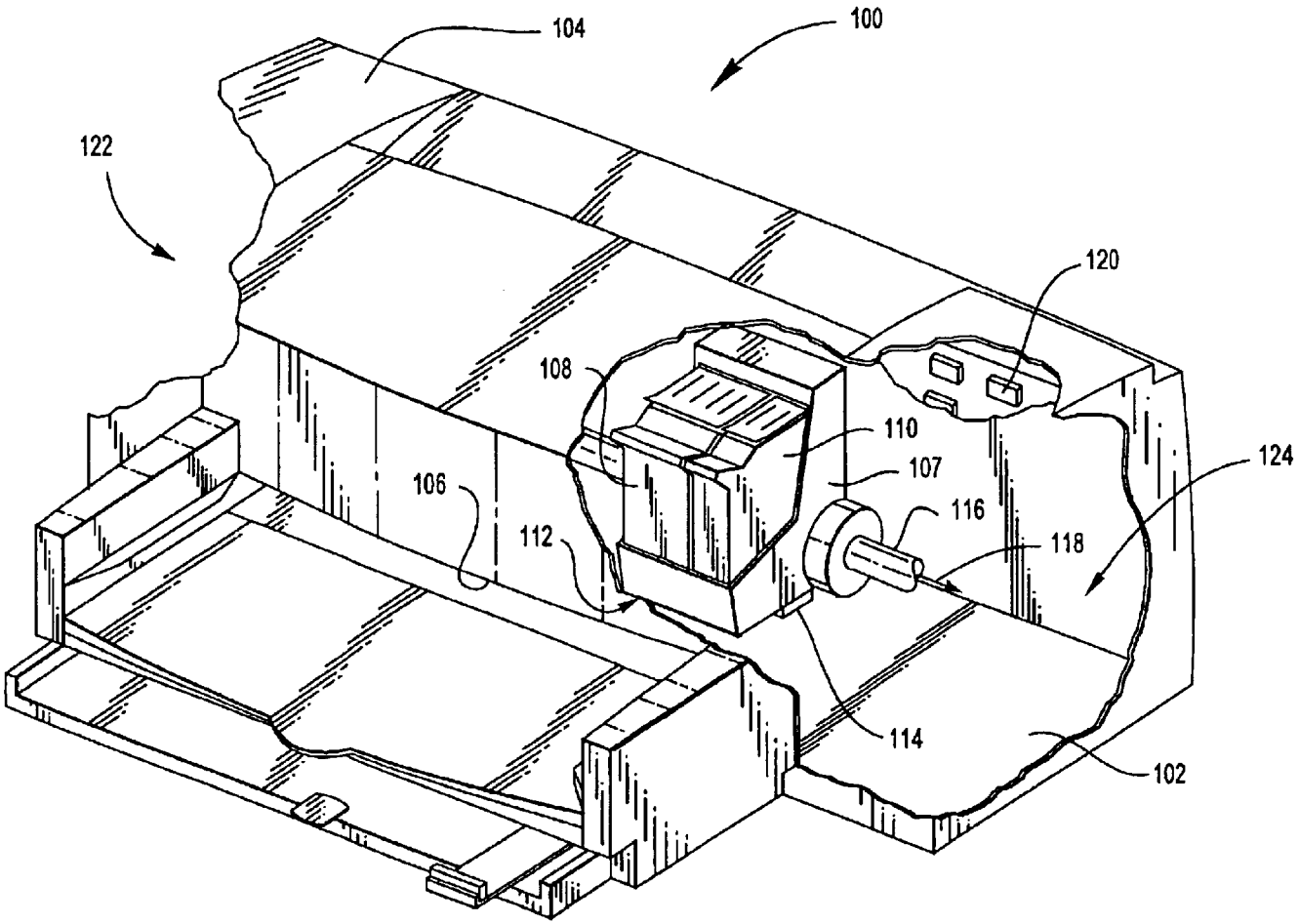
FIG. 1 is a fragmented, partially schematic, perspective view of an exemplary embodiment of the present invention of an inkjet printing mechanism.

For convenience, the concepts of the present invention are illustrated in the environment of an inkjet printer 100, while it is understood that the present invention as illustrated by the exemplary embodiment can also be used in other inkjet printing mechanisms such as facsimile machines and copiers.

The typical inkjet printer includes a chassis 102 surrounded by a housing or casing enclosure 104.

The printer 100 also has a printer controller, illustrated schematically as a microprocessor 120, that receives instructions from a host device, typically a computer, such as a personal computer (not shown), and manages different operations of different components of the printer 100.

A carriage guide rod 116 is supported by the chassis 102 to slidably support an inkjet carriage 107 for travel back and forth along a scanning axis 118 defined by the guide rod 116 across a printing area 106 within which images are imprinted onto media sheets. A conventional carriage propulsion system may be used to drive the carriage 107, including a position feedback system, which communicates carriage position signals to the controller 120. For instance, a carriage drive gear and DC motor assembly (not shown) may be coupled to drive an endless belt (not shown) secured in a conventional manner to the carriage 107, with the motor operating in response to control signals received from the printer controller 120. To provide carriage positional feedback information to the printer controller 120, an optical encoder reader (not shown) may be mounted to the carriage 107 to read an encoder strip (not shown) extending along the path of carriage travel.

In the printing area 106, the media sheet receives ink from an inkjet cartridge, such as a black ink cartridge 108 and/or a color ink cartridge 110. The cartridges 108, 110 are also often called "pens" by those in the art and are typically contained in the carriage 107. The illustrated color pen 110 is a tri-color pen, although in some embodiments, a set of discrete monochrome pens may be used. Furthermore, for the purpose of this description, the color pen 110 is defined to be located on the right side of the black pen 108 as shown in FIG. 1.

The illustrated pens 108, 110 each include a reservoir for storing a supply of ink. The pens 108, 110 also have printheads 112, 114 respectively, each of which has an orifice plate with a plurality of nozzles formed therethrough in a manner well known to those skilled in the art. Ink drops are ejected from the nozzles to the media sheet during printing operations. The illustrated printheads 112, 114 are thermal inkjet printheads, although other types of printheads may be used, such as piezoelectric printheads.

Other components are arranged within the casing 104 for handling media sheets and imprinting images on the media sheets. A detailed description of the various printer components and their function is not provided herein, since they are generally understood by those with ordinary skill in the art.

The carriage 107 can be propelled along the guide rod 116 into a left and a right wiping region, as indicated generally by arrows 122 and 124, located within the interior of the casing 104 for independently wiping the printheads of the black pen 108 and the color pen 110 respectively. The wiping regions 122, 124 are separated by a substantial distance from each other since they are located on the two opposite sides of the printer respectively.

Figure 2:
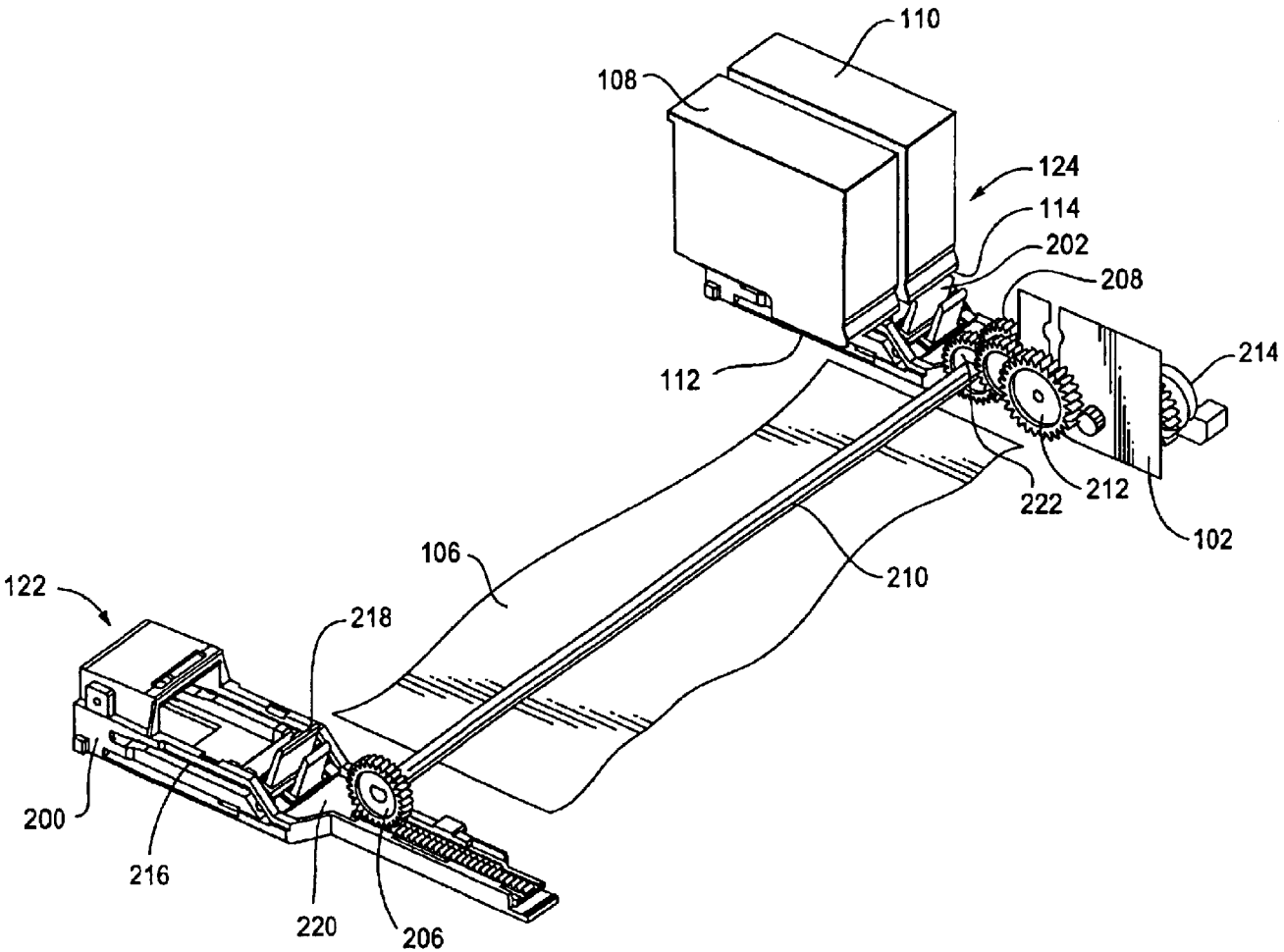
FIG. 2 is a perspective view illustrating an exemplary embodiment of the present invention of a wiper mechanism that can be used in the printing mechanism of FIG. 1.

In FIG. 2, a left and a right wiping assembly 200, 202 are respectively positioned at the left and right wiping regions 122, 124 for independent wiping of the printheads 112, 114 of the black and color pens 108, 110 respectively. The wiping assemblies 200, 202 are positioned at the opposite ends out of the printing area 106 along the scanning axis 118 (see FIG. 1), and within the printing area ink drops are ejected from the printheads onto a media sheet during printing operations.

When the printhead 114 of the color pen 110 needs wiping, supported by the carriage 107 as shown in FIG. 1, both pens move to the right wiping region 124, where the color pen 110 is positioned above the right wiping assembly 202. Subsequently, driven by a motor 214 through a gear train 212, the right wiping assembly 202 moves back and forth substantially perpendicularly to the scanning axis 118 (see FIG. 1) and wipes the printhead 114 of the color pen 110 accordingly. Note that when the pens 108, 110 stay in the right wiping region 124, the left wiping assembly 200 is not in contact with the printhead 112 of the black pen 108, since it is separated from the right wiping region 124 by the printing area 106.

When the printhead 108 of the black pen 108 needs wiping, however, both pens move to the left wiping region 122 instead. At this time, the left wiping assembly 200 wipes the printhead 108 of the black pen 112, with the right wiping assembly 202 not in contact with the printhead 114 of the color pen 110.

A servicing algorithm executed by the controller 120 (see FIG. 1) determines which printhead needs wiping, to which wiping region the carriage moves, and what amount of wiping is needed. A detailed description of such a mechanism is not provided herein, since it is generally understood by those with ordinary skill in the art. For instance, U.S. Pat. No, 6,126,265, assigned to the present assignee, Hewlett-Packard Company, discloses a service station control procedure and is herein incorporated by reference.

In this way, independent wiping of individual printhead is achieved.

In FIG. 2, a right wiper gear 206 and a left wiper gear 208 are respectively mounted on two sides of a rotatable wiper shaft 210 for respectively driving the left and right wiping assemblies. The wiper shaft 210 is rotated during wiping operations by the motor 214 through the gear train 212 and a gear 222. The gear 222 is mounted on one side of the wiper shaft 210 to engage with the gear train 212 and receive the driving forces from the motor 214. Additionally, each wiping assembly 200, 202 has a flexible wiper blade 218 mounted on a platform (not shown), which is slidable along a guide track 216 mounted to the chassis 102. Each platform is connected to a tooth rack 220, which is engaged with one of the wiper gears 206, 208 through the engagement between the teeth of the gear and the rack. In this way, when the wiper shaft 210 is rotated, both wiper blades 218 are moved back and forth substantially perpendicularly to the scanning axis 118 (see FIG. 1) so that one of the printheads, which is in contact with one of the wiper blades 218, can be wiped.

Figure 3A:
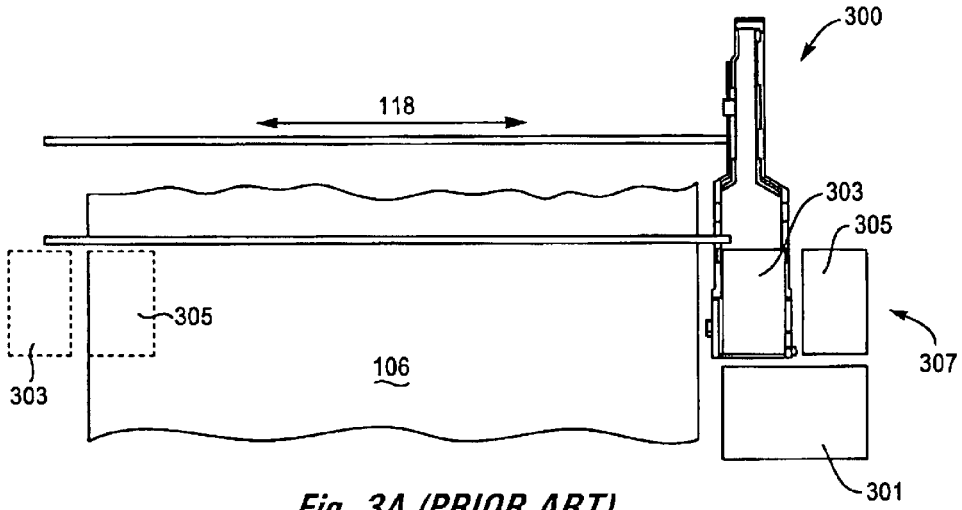
Fig. 3A (PRIOR ART)
FIG. 3A is a top plan view illustrating the position of a conventional wiper assembly relative to a printing area in a conventional printing mechanism.
Figure 3B:
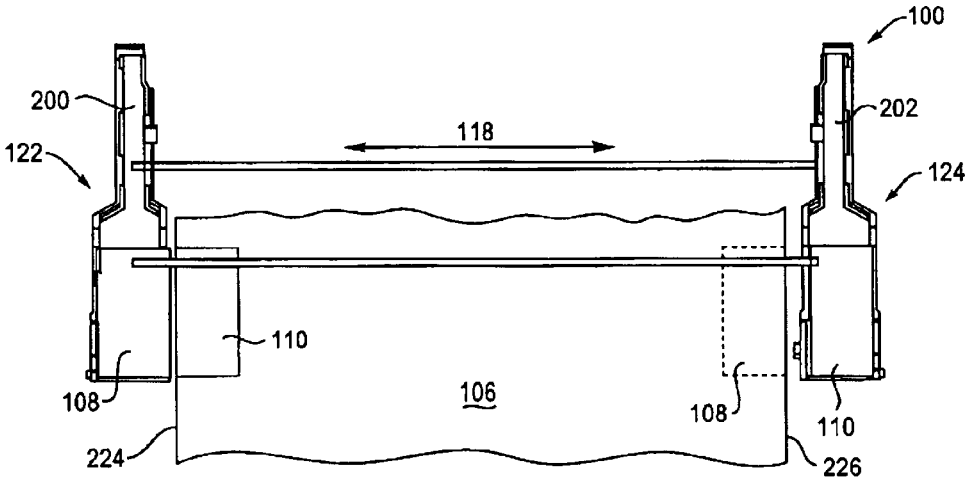
FIG. 3B is a top plan view illustrating the positions of the wiper assemblies of FIG. 2 relative to the printing area.

As shown in FIG. 3B, the printing area 106 extends along the scanning axis 118, and within the printing area ink drops are ejected from printheads onto a media sheet during printing operations. In addition, the left pen, i.e., the black pen 108 in the exemplary embodiment, needs to travel out of the left edge 224 of the printing area 106 to allow the color pen 110 to print onto the left of the media sheet. Similarly, the right pen, namely the color pen 110, needs to travel out of the right edge 226 of the printing area 106. A sweeping area (not shown) is defined by the furthest positions along the scanning axis 118 that the pens can travel during printing operations. Such a sweeping area affects the width of the printer along the scanning axis 118.

FIG. 3A is a simplified top plan view of an inkjet printer 300 that has a left pen 303 and a right pen 305 and uses a conventional wiping assembly 301 located at a wiping region 307 on the right side of the printer. Conventionally, such a wiping assembly is positioned out of the printing area 106, and both pens 303, 305 need to move out of the printing area and to be stationed above the wiping assembly 301 for wiping. Therefore, in FIG. 3A, the width of the printer 300 along the scanning axis 118 is approximately the width of the sweeping area (not shown) plus the width of the right pen 305.

In the printer 100 of the present application of FIG. 3B, the wiping assemblies 200, 202 are located out of the printing area 106 but each in close proximity to the left and right edges of the printing area respectively so that the wiping assemblies are within the sweeping area (not shown). Furthermore, the left and right wiping assemblies 200, 202 are aligned with the left and right pens 108, 110 respectively, when during the printing operations the pens travel to the left and right edges of the sweeping area (not shown). By limiting the width of the wiping assemblies to be not more than the width of the pens, the width of the printer can be limited to approximately the width of the sweeping area (not shown). Compared to the conventional printer of FIG. 3A with a conventional wiping assembly positioned in a conventional wiping region, the width of the exemplary printer of the present application as shown in FIG. 3B is reduced by approximately the width of one pen.

What is claimed is:

1. A method for wiping a first and a second printhead of an inkjet printing mechanism, wherein the printheads are movable along a scanning axis in the printing mechanism, comprising providing a first and a second wiping region separated by a substantial distance from each other along the scanning axis, providing a first and a second wiping assembly respectively located at the first and second wiping regions, determining which printhead needs wiping, selecting one of the wiping regions that corresponds to the printhead that needs wiping, moving both printheads to the one of the wiping regions resulting from the selection, wherein the one of the wiping regions is the first wiping region, and subsequently wiping the first printhead by the first wiping assembly located at the first wiping region, without the second printhead being simultaneously wiped by the second wiping assembly.

2. The method of claim 1, further comprising providing a printing area extending along the scanning axis within the printing mechanism, within which area ink drops are projected from at least one of the printheads onto a media sheet for imprinting images on it, and locating the first and second wiping assemblies at opposite ends out of the printing area.

3. The method of claim 2, further comprising:

providing a sweeping area extending along the scanning axis within the printing mechanism, within which area the printheads travel during printing operations, and locating the first and second wiping assemblies within the sweeping area for minimizing a width of the printing mechanism.

4. An inkjet printing mechanism, comprises:

a chassis, a first and a second printhead, supported by the chassis, a carriage that transports both printheads together along a scanning axis, a first wiping assembly located at a first wiping region for wiping the first printhead when the carriage moves to the first wiping region, and a second wiping assembly located at a second wiping region for wiping the second printhead when the carriage moves to the second wiping region, wherein the wiping regions are separated by a substantial distance from each other along the scanning axis such that the two printheads are independently wiped by the two wiping assemblies respectively, and wherein the printing mechanism further comprising means for selecting one wiping region between the two wiping regions depending upon which printhead needs wiping, and means for moving the carriage to said one wiping region for wiping one of the printheads without wiping the other printhead simultaneously.

5. An inkjet printing mechanism comprises chassis, a first and a second printhead, supported by the chassis, a carriage that transports both printheads together along a scanning axis, a first wiping assembly located at a first wiping region for wiping the first printhead when the carriage moves to the first wiping region, and a second wiping assembly located at a second wiping region for wiping the second printhead when the carriage moves to the second wiping region, wherein the wiping regions are separated by a substantial distance from each other along the scanning axis such that the two printheads are independently wiped by the two wiping assemblies respectively, and wherein the printing mechanism further comprising means for synchronizing movements of both wiping assemblies, and a motor connected to one of the wiping assemblies for driving both wiping assemblies during wiping operations.

* * * * *